United States Patent [19]

Olivieri

[11] Patent Number: 4,669,153

[45] Date of Patent: Jun. 2, 1987

[54] DEVICE FOR THE SNAP-FIXING OF FITTINGS TO THE UPPER OF A SKI-BOOT

[75] Inventor: Oliviero Olivieri, Montebelluna, Italy

[73] Assignee: Icaro Olivieri & C.S.p.A., Montebelluna, Italy

[21] Appl. No.: 668,960

[22] Filed: Nov. 7, 1984

[30] Foreign Application Priority Data

Nov. 8, 1983 [IT] Italy ..... 23486/83 [U]

[51] Int. Cl.[4] ..... A43C 11/00

[52] U.S. Cl. ..... 24/68 SK; 24/682; 24/686; 36/50

[58] Field of Search ..... 36/50, 117–121; 24/71 SK, 70 SK, 70 R, 68 R, 69 SK, 68 SK, 69 R, 140, 306, 117 R, 144, 146, 145, 148, 620, 621, 682, 686, 687, 691

[56] References Cited

U.S. PATENT DOCUMENTS

| | | | |
|---|---|---|---|
| 374,984 | 12/1887 | McHenry | 24/69 SK |
| 834,808 | 10/1906 | Holmes | 24/621 |
| 957,651 | 5/1910 | Brown | 24/71 SK |
| 1,083,573 | 1/1914 | Wehrwein | 24/140 |
| 1,129,149 | 2/1915 | Westlake | 24/117 R |
| 1,137,381 | 4/1915 | Burkel | 24/117 R |
| 1,239,610 | 9/1917 | Loyland | 24/71 SK |
| 2,913,793 | 11/1959 | Tallarico | 24/146 |
| 3,205,544 | 9/1965 | Streule et al. | 24/306 |
| 3,287,774 | 11/1966 | Binding et al. | 24/70 SK |
| 4,020,571 | 5/1977 | Olivieri | 36/50 |
| 4,190,969 | 3/1980 | Baso | 24/70 SK X |

FOREIGN PATENT DOCUMENTS

| | | | |
|---|---|---|---|
| 2631398 | 2/1977 | Fed. Rep. of Germany | 36/120 |
| 2712737 | 9/1978 | Fed. Rep. of Germany | 24/71 SK |
| 1236427 | 6/1960 | France | 24/145 |
| 1474955 | 3/1967 | France | 24/70 SK |
| 20621 | of 1905 | United Kingdom | 24/620 |
| 646071 | 11/1950 | United Kingdom | 24/71 SK |

*Primary Examiner*—Kenneth J. Dorner
*Assistant Examiner*—James R. Brittain
*Attorney, Agent, or Firm*—Fleit, Jacobson, Cohn & Price

[57] ABSTRACT

A device for fitting fixings to the upper of a ski-boot comprises a plate-shaped base fixed to a respective fitting, and a plate-shaped counterbase which is essentially snap-engaged with the plate-shaped base from within the upper through a hole formed therein. The easy assembly and firm anchorage of the fitting to the upper is thus achieved.

1 Claim, 3 Drawing Figures

DEVICE FOR THE SNAP-FIXING OF FITTINGS TO THE UPPER OF A SKI-BOOT

The present invention relates to a device for fixing fittings, such as hooks, tie-rods, straps and the like, to the upper of a ski-boot.

The operation of fixing fittings to the upper is known to be very delicate. In fact, on the one hand, it is necessary for the fixing to be very firm in order to withstand the high forces exerted during sporting activity; on the other hand, it is necessary for the assembly to be quick and rapid so as to keep the costs low.

The devices known at present generally use one or more rivets. Thus, the requirement of firm fixing is satisfied but not that of cheap assembly. Indeed, when used on a complex structure such as that of a ski-boot upper, the rivet needs to be put in by hand, which is obviously very expensive.

The object of the present invention, therefore, is to provide a device which overcomes the cited drawbacks of the prior art, while allowing the easy, rapid and secure fixing of fittings to a ski-boot upper.

The present invention achieves this object by a device comprising a plate-shaped base fixed to a respective fitting, and a plate-shaped counterbase which is essentially snap-engaged with the plate-shaped base from within the upper through a through-hole formed therein.

Further characteristics and advantages of a device according to the invention will become apparent from the following description of one preferred embodiment given with reference to the appended drawings, in which.

Figure 1:
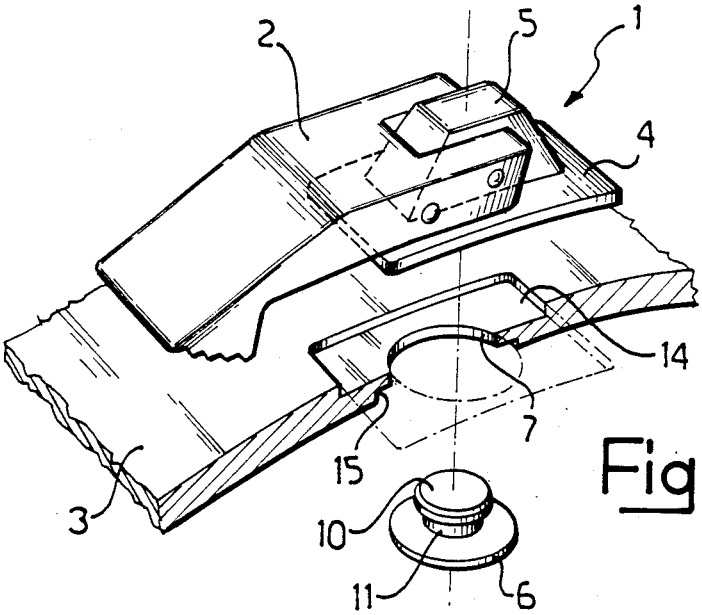
FIG. 1 is an exploded perspective view of a device according to the invention.
Figure 2:
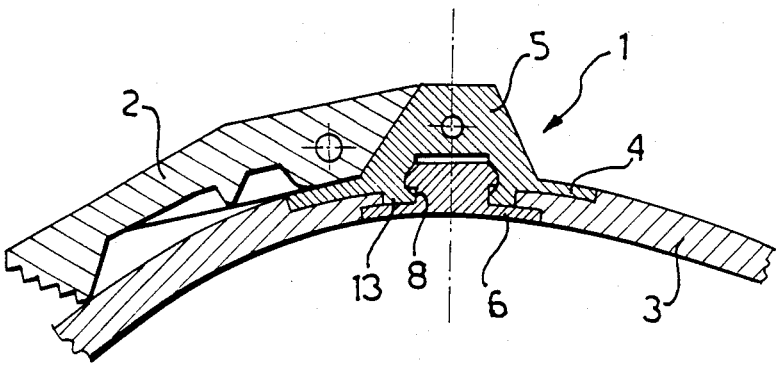
FIG. 2 is a sectional view of the device of FIG. 1.
Figure 3:
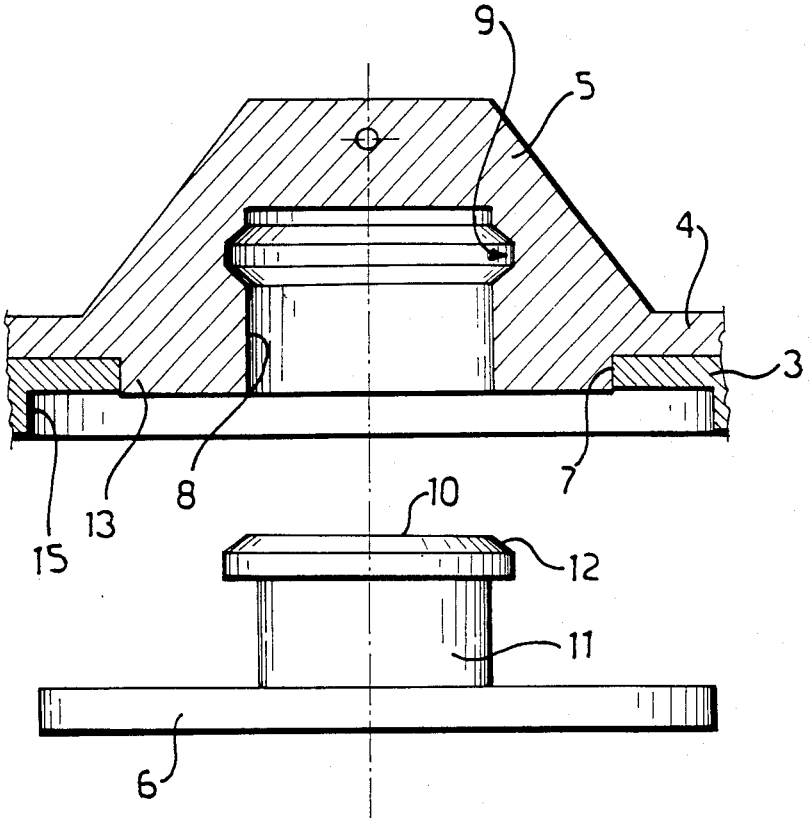
FIG. 3 is a sectional view of a detail of the device of FIG. 2 on an enlarged scale, with the parts separated.

In the drawings, a device for fixing a fitting, for example a hook 2, to a ski-boot upper 3 (of which only that portion adjacent the device 1 is shown) is generally indicated 1.

The device 1 includes a plate-shaped base 4 surmounted by a lug 5 on which the hook 2 is rotatably mounted in a conventional manner.

A plate-shaped counterbase 6 is coupled with the base 4 from within the upper 3 through a through-hole 7 formed in the upper 3 itself. The coupling between the base 4 and the counterbase 6 is essentially a snap-engagement.

For this purpose, the base 4 is formed with a blind hole 8 having an annular seat 9 for coupling with a mushroom head 10 of a pin 11 integral with the counterbase 6. The head 10 has a bevel 12 for facilitating its insertion in the seat 9 through the hole 8.

To advantage, the base 4 has a shoe 13 for insertion in the hole 7.

In a preferred embodiment, the base 4 and the counterbase 6 are set into the upper 3. For this purpose, the base 4 is housed in a corresponding seat 14 formed in the outside of the upper 3 and the counterbase 6 is housed in a corresponding seat 15 formed in the inside of the upper 3. The seats 14 and 15 have depths substantially equal to the thickness of the base 4 and the counterbase 6 respectively.

In order to fit the device 1 to the upper 3, it is necessary to locate the base 4 in the seat 14 with the shoe 13 inserted in the hole 7. The counterbase 6 is positioned with the head 10 of the pin 11 against the mouth of the blind hole 8 through the through-hole 7. At this point, it suffices to thrust the head 10 into the hole 8 with sufficient force for it to reach its seat 9. The locking of the counterbase 6 to the base 4 is thus effected.

Thus, the device 1 is fixed firmly to the upper 3 and can withstand the forces even of furious sporting activity. On the other hand, as seen, the assembly is very simple and lends itself extremely well to being robotised, given the relatively small force necessary.

Naturally, if it is wished to leave the device 1 with a certain freedom of rotation, the plate 4 and the counterplate 6 will not be inset but will rest freely against the upper 3.

What is claimed is:

1. A device for fixing a fitting on an upper of a ski-boot, said device comprising:

a first seat defined by a first recess in one side of said upper, a plate-shaped base of complimentary dimension with said first recess, said plate-shaped base resting in said first seat and contacting said upper, fitting means attached to said plate-shaped base, a second seat defined by a second recess in another side of said upper, opposite to said first seat in said one side, a counter-base of complimentary dimension with said second recess resting in said second seat and contacting said upper, a hole defined in said upper, said hole extending beyond said first seat and said second seat, a shoe integral with and extending from said plate-shaped base being inserted in said hole, a blind hole defined within said shoe and said plate-shaped base, said blind hole including an annular seat of greater transverse dimension than the entrance of said blind hole, and a pin integral with said counter-base, said pin having a mushroom head snap coupled in said annular seat and extending into said hole to fix said plate-shaped base and said counter-base securely on said upper.

* * * * *